US009771735B2

(12) United States Patent
Finnegan

(10) Patent No.: US 9,771,735 B2
(45) **Date of Patent: *Sep. 26, 2017**

(54) POST REINFORCEMENT

(71) Applicant: Gregory Michael Finnegan, Dayton, OH (US)

(72) Inventor: Gregory Michael Finnegan, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/452,146

(22) Filed: Mar. 7, 2017

(65) Prior Publication Data

US 2017/0175412 A1 Jun. 22, 2017

Related U.S. Application Data

(63) Continuation of application No. 15/004,486, filed on Jan. 22, 2016, now Pat. No. 9,657,493.

(60) Provisional application No. 62/107,041, filed on Jan. 23, 2015.

(51) Int. Cl.
*E04H 12/22* (2006.01)

(52) U.S. Cl.
CPC ..... *E04H 12/2292* (2013.01); *E04H 12/2215* (2013.01); *E04H 12/2269* (2013.01)

(58) Field of Classification Search
CPC ..... E04H 12/2292; E04H 12/2269; E04H 12/2215; E04H 17/22
USPC ..... 52/165
See application file for complete search history.

(56) References Cited

U.S. PATENT DOCUMENTS

| | | | | |
|---|---|---|---|---|
| 405,658 | A | 6/1889 | Campany | |
| 1,584,405 | A | 5/1926 | Spring | |
| 1,597,573 | A * | 8/1926 | Blue | E04H 13/003 248/156 |
| 1,706,684 | A | 3/1929 | Welsz | |
| 1,712,364 | A | 5/1929 | Spring | |
| 1,789,393 | A | 1/1931 | Spring | |
| 3,974,604 | A * | 8/1976 | Conn | E02D 5/805 405/244 |
| 4,598,512 | A | 7/1986 | Chapman | |
| 4,646,489 | A * | 3/1987 | Feller | E04H 12/2253 256/DIG. 5 |
| 4,697,396 | A | 10/1987 | Knight | |
| 4,874,149 | A * | 10/1989 | Miceli | E04H 12/2215 248/156 |
| 5,090,656 | A * | 2/1992 | Brown | E04H 12/2215 248/530 |
| 5,261,760 | A * | 11/1993 | Castonguay | A01G 1/08 404/7 |

(Continued)

OTHER PUBLICATIONS

U.S., Non-Final Office Action, U.S. Appl. No. 15/004,486, 13 pages (dated Jun. 13, 2016).

(Continued)

*Primary Examiner* — Paola Agudelo
(74) *Attorney, Agent, or Firm* — Thompson Hine LLP

(57) ABSTRACT

A post reinforcement including a panel having a body portion and a stake portion. The post reinforcement further includes a first barb coupled to and extending away from the panel, wherein the first barb is generally positioned on a first side of the panel. The post reinforcement also includes a second barb coupled to and extending away from the panel, wherein the second barb is generally positioned on a second side of the panel opposite the first side.

18 Claims, 4 Drawing Sheets

(56) References Cited

U.S. PATENT DOCUMENTS

| | | | | |
|---|---|---|---|---|
| 5,307,603 | A * | 5/1994 | Chiodo | E04B 1/2608 52/297 |
| 5,345,732 | A | 9/1994 | Knight et al. | |
| 5,622,356 | A * | 4/1997 | Duggan | E04H 12/2292 256/1 |
| 5,636,482 | A | 6/1997 | Klager | |
| 5,815,994 | A | 10/1998 | Knight et al. | |
| 6,101,780 | A * | 8/2000 | Kreidt | E04B 1/2608 52/281 |
| 6,340,147 | B1 | 1/2002 | Dymarczyk | |
| 6,578,826 | B2 | 6/2003 | Pilcher | |
| 6,826,800 | B2 * | 12/2004 | Kao | B60B 33/0002 16/29 |
| 7,730,675 | B2 * | 6/2010 | Hill | E04H 12/2215 248/530 |
| 8,584,413 | B1 * | 11/2013 | Keller, Sr. | E02D 27/32 52/297 |

OTHER PUBLICATIONS

U.S., Final Office Action, U.S. Appl. No. 15/004,486, 15 pages (dated Sep. 23, 2016).
U.S., Advisory Action, U.S. Appl. No. 15/004,486, 4 pages (dated Nov. 16, 2016).
U.S., Notice of Allowance, U.S. Appl. No. 15/004,486, 7 pages (dated Dec. 8, 2016).

* cited by examiner

POST REINFORCEMENT

POST REINFORCEMENT

This application is a continuation of U.S. application Ser. No. 15/004,486 entitled POST REINFORCEMENT and filed on Jan. 22, 2016, which in turn claims priority to U.S. Provisional Patent Application Ser. No. 62/107,041 entitled POST REINFORCEMENT and filed on Jan. 23, 2015. The entire contents of both of these applications are hereby incorporated by reference.

The present invention is directed to a post reinforcement, and more particularly, to a post reinforcement which can at least partially surround and reinforcement a post.

BACKGROUND

Posts and poles can be used in a variety of manners such as porch supports, fence posts, telephone/utility poles, and the like. The posts are often located outdoors, and in some cases are installed and set in cement foundations, for example foundations up to around three to four feet deep. When the post is made of wood or other materials susceptible to degradation, wear or rot, the post may lose structural integrity due to repeated exposure to moisture and natural forces, thereby putting the post at risk for failure.

Posts are typically most vulnerable to rotting at or just below ground level. In particular, when such posts are set in concrete, rain water typically collects on top of the concrete, thereby increasing the post's exposure to moisture at or just below ground level. In many cases, aside from a weakened portion at or near ground level, the remainder of the length of the post is structurally sound. Accordingly, reinforcement of the post at ground level may increase the useful life of the post as a functional support and help to avoid or postpone the costs associated with replacing the entire post.

SUMMARY

In one embodiment, the invention is a post reinforcement including a panel having a body portion and a stake portion. The post reinforcement further includes a first barb coupled to and extending away from the panel, wherein the first barb is generally positioned on a first side of the panel. The post reinforcement also includes a second barb coupled to and extending away from the panel, wherein the second barb is generally positioned on a second side of the panel opposite the first side.

DETAILED DESCRIPTION

Figure 1:
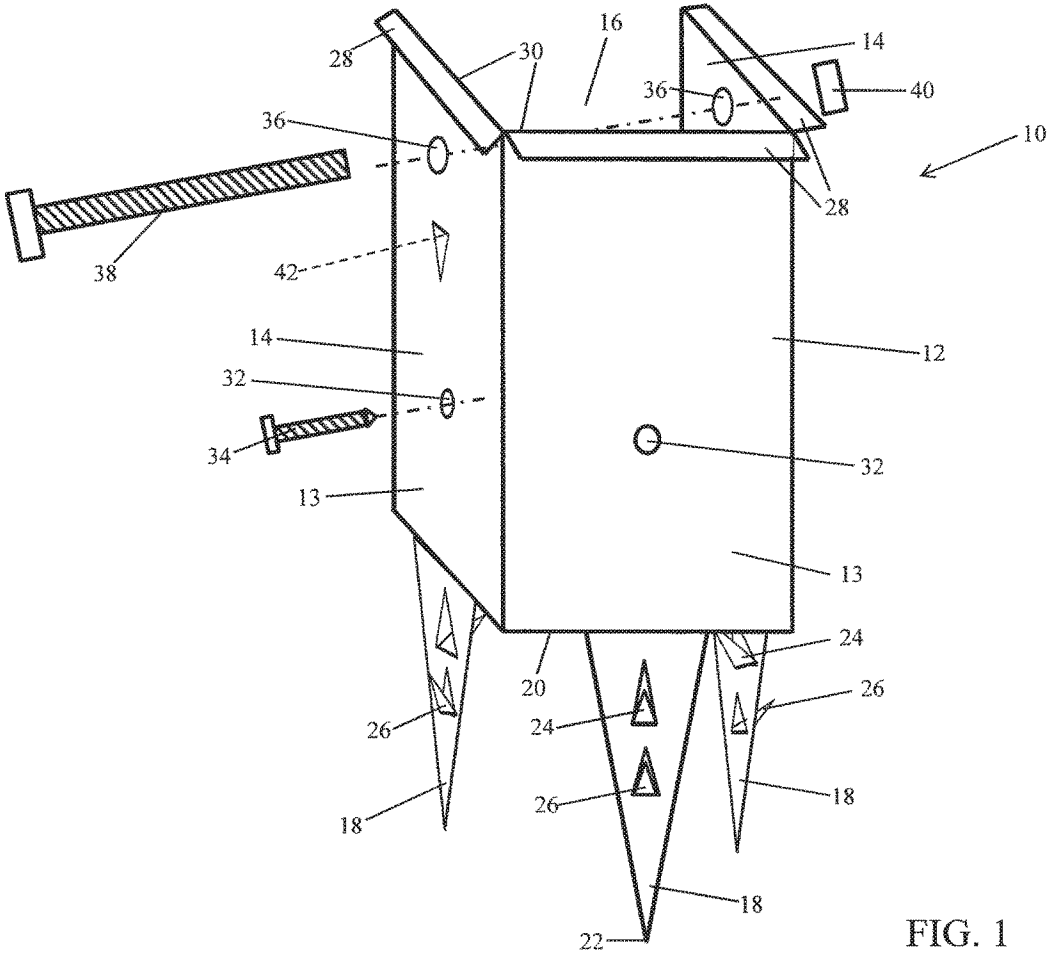
FIG. 1 is a front perspective view of one embodiment of a post reinforcement.
Figure 4:
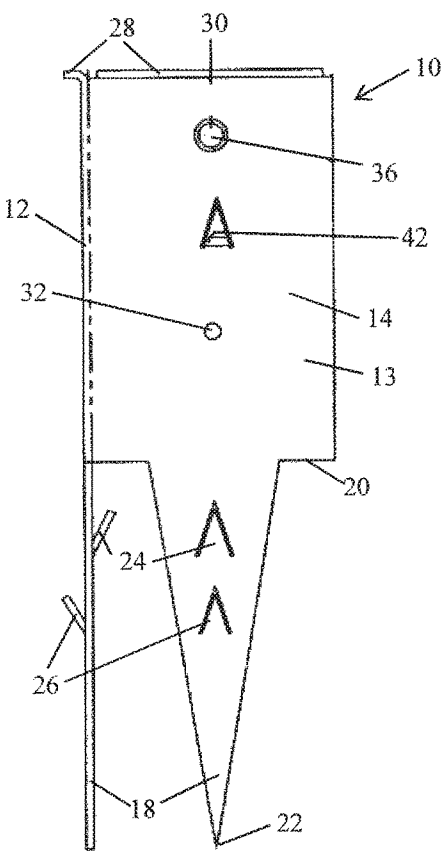
FIG. 4 is right side view of the post reinforcement of FIG. 1.
Figure 3:
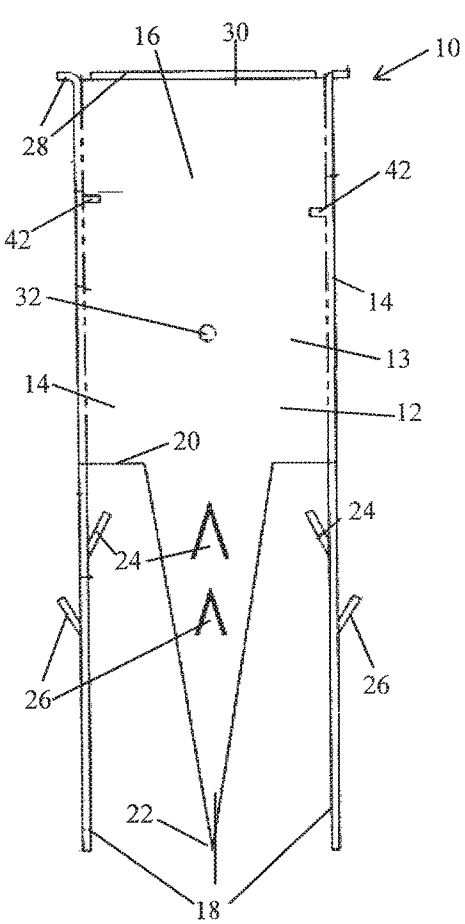
FIG. 3 is a rear (interior) view of the post reinforcement of FIG. 1.

With reference to FIGS. 1-5, an embodiment of a post reinforcement 10 includes a center or main panel 12 and two opposed side panels 14 positioned an opposite ends of the main panel 12. Each of the panels 12, 14 is shown as a generally flat, rectangular piece of sheet-like material with a generally rectangular body or body portion 13. The center panel 12 and each side panel 14 are set at angles to each other to define a cavity or receptacle 16 therebetween that is sized and shaped to receive a post or pole 15 (FIG. 5) therein, such a wooden post. In the depicted embodiment, the panels 12, 14 are roughly equally shaped and sized, and positioned at about 90° relative to the adjacent panel(s) such that the receptacle 16 has a generally square or rectangular cross-section, for example to receive a 4"×4" post 15.

Though the post reinforcement 10 is depicted with three total panels 12, 14, it should be understood that the post reinforcement 10 may include more panels, up to and including an amount sufficient to completely enclose the post 15, if desired. Alternatively, the post reinforcement 10 can include fewer panels than those shown to abut fewer sides of the post 15 (for example, one of the depicted panels 14 could be omitted). It should be further understood that the panels 12, 14 may take any shape, size, and relative orientation as appropriate to closely receive and/or fit about a particular target post 15, including posts with any of a variety of polygonal and/or curved cross sections. In one embodiment, the post reinforcement 10 may include only a single curved panel, or more than one panel, to define a receptacle 16 with a generally semicircular or generally circular cross-section, for example to receive a cylindrical pole.

Figure 5:
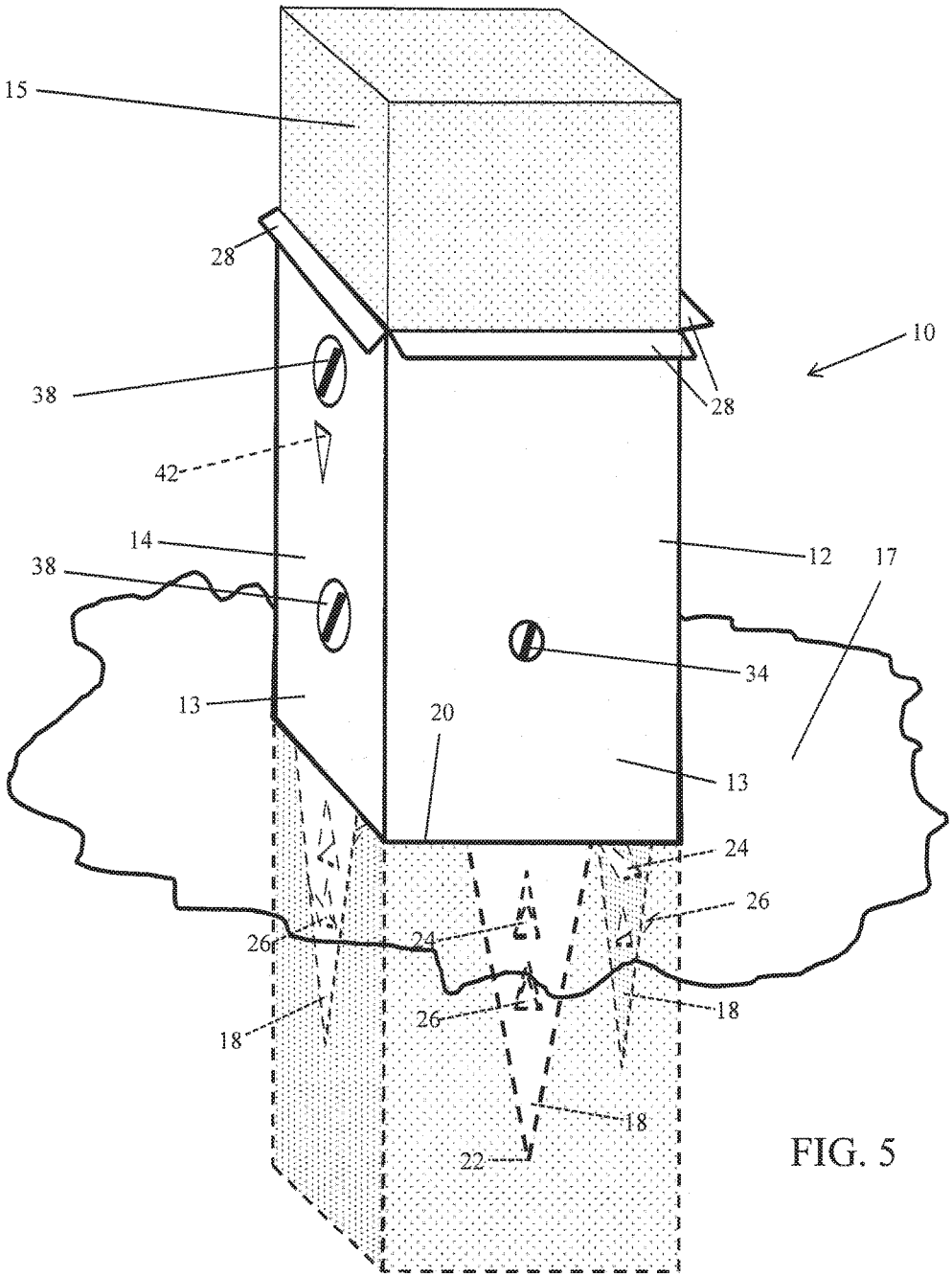
FIG. 5 illustrates the post reinforcement of FIG. 1 secured to an embedded post.

One or more of the panels 12, 14 can have a stake portion 18 or portions 18 extending from a bottom 20 of the body portion 13 of the respective panel 12, 14. The stake portion 18 may be integrally formed with the panel 12, 14, or alternatively formed of a separate piece of material. When the post reinforcement 10 is installed on a post 15, the stake portion 18 is driven downward between the post 15 and the surrounding support structure, substrate or surface 17 (e.g., the cement foundation, soil, etc.) as shown in FIG. 5. Each stake portion 18 may taper to a point 22, which may facilitate installation of the post reinforcement 10 by providing a penetrating point.

The post reinforcement 10 may be able to be pounded into place from above with a hammer, mallet, or the like, by concentrating the force of the blows to a small surface area (via the points 22 in one case) and driving the post reinforcement 10 into/below the surrounding support structure 17. In the depicted embodiment, each of the three panels 12, 14 includes a stake portion 18, and each stake portion 18 has about the same size and shape. Alternately, the post reinforcement 10 may include stake portions 18 on fewer than all of the panels 12, 14, and/or different panels 12,14 may include stake portions 18 with different shapes and/or dimensions (length and/or width). Further alternately the post reinforcement 10 can include multiple stake portions 18 per panel 12, 14, and/or stake portions 18 with shapes different from the triangular shape of the depicted embodiment, for example jagged/serrated, W-shaped, U-shaped, square-shaped, trapezoidal, or any of a variety of other polygonal or curved forms.

Figure 2:
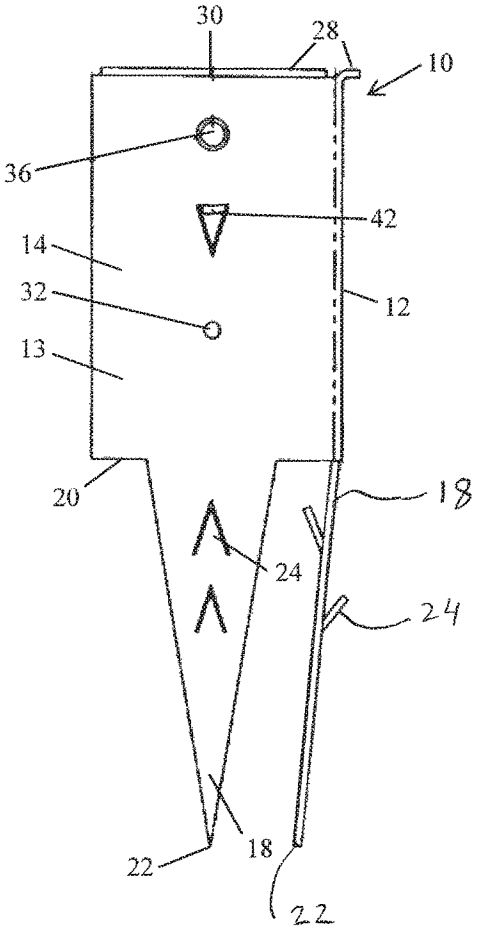
FIG. 2 is a left side view of the post reinforcement of FIG. 1, but showing an inwardly-angled stake portion.
Figure 6:
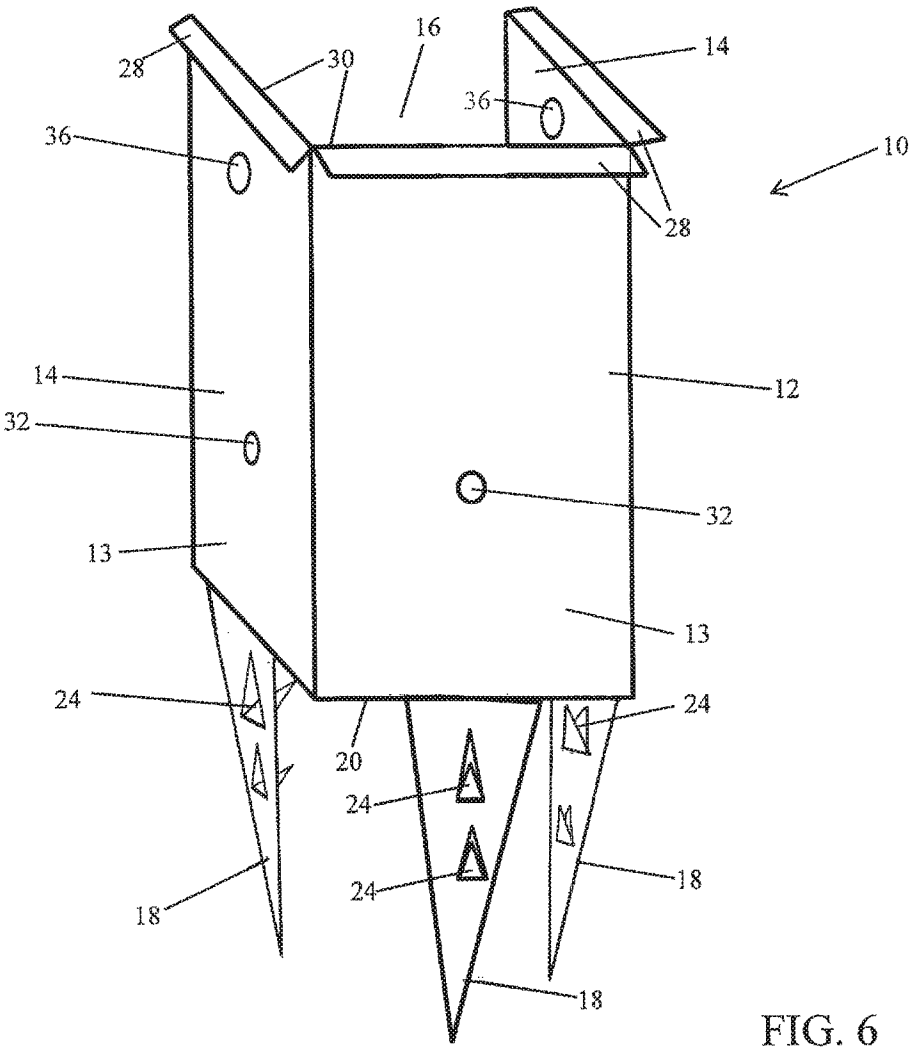
FIG. 6 is a front perspective view of another embodiment of the post reinforcement.

In one embodiment one or more, or all (see FIG. 6), of the stake portions 18 may be angled slightly inward toward the receptacle 16, or the stake portions 18 may be otherwise inwardly-biased and/or spring-loaded. For example, in one case each stake portion 18 is angled inwardly relative to the body 13 of the associated panel 12, 14 by up to about 20° or less, or up to about 10° or less. Only the stake portion 18 associated with the main panel 12 in FIG. 2 is shown angled in this manner for illustrative purposes, although it should be understood the other stake portions 18 may be similarly angled. Accordingly, in this embodiment, to install the post reinforcement 10 onto a post 15, the stake portion(s) 18 may need to be splayed slightly outwardly from their normal position (for example, into planar alignment with the body 13 of the panels 12, 14), to allow the reinforcement 10 to receive the post 15 in the receptacle 16. Thus, when the reinforcement 10 is positioned on the post 15, the stake portions 18 are biased into the sides of the post 15 in a gripping fashion, and the points 22 may at least slightly initially penetrate into the post 15. When the post reinforcement 10 is driven into the support structure 17 from above, the points 22 may further penetrate into the post 15 for a more secure installation.

One or more of the stake portions 18 may further include inwardly-oriented barbs 24 that project into/toward the receptacle 16 and/or outwardly-oriented barbs 26 that project outwardly from the stake portions 18 away from the receptacle 16 and toward the surrounding support structure 17. In the depicted embodiment, the inwardly-oriented barbs 24 are positioned above the outwardly-oriented barbs 26 (i.e. the inwardly-oriented barbs 24 are positioned between the outwardly-oriented barbs 26 and body 13 of the panels 12, 14), and the inwardly-oriented barbs 24 are larger in size, but this need not be the case. In embodiments with multiple stake portions 18, each stake portion 18 need not necessarily include the same number and/or configuration of barbs 24, 26. When the post reinforcement 10 is installed on a post 15, the inwardly-oriented barbs 24 anchor into the body of the post 15, for example by fully or partially penetrating into the post 15 below ground level, thereby improving stability of the system. If the stake portions 18 are angled inwardly, this helps to drive the barbs 24 into the post 15. The outwardly-oriented barbs 26 anchor into the surrounding support structure 17, providing resistance against uprooting of the post reinforcement 10 once installed.

The barbs 24, 26 may be set at a slight angle, for example up to about 30° or less, or up to about 15° or less, relatively to a main portion/body portion of the associated stake portion 18. In the depicted embodiment, the barbs 24, 26 are generally triangular in shape, and are integrally formed with the stake portions 18. However it should be appreciated that the barbs 24, 26 may alternately be external components attached to the stake portions 18, and that the barbs 24, 26 may be formed in any of a variety of shapes, for example jagged/serrated, W-shaped, U-shaped, square-shaped, trapezoidal, or any of a variety of other polygonal or curved forms.

The post reinforcement 10 may include one or more strike surfaces 28 to facilitate installation thereof. In one embodiment, the strike surface 28 takes the form of a flange positioned at or proximate to the top 30 of the body 13 of one or more of the panel 12, 14. The strike surface 28 may be a flange or surface that extends generally perpendicularly from the body 13 of the panel 12, 14 to which it is attached, as depicted. Alternately the strike surface(s) 28 may be positioned anywhere along one or more of the panels 12, 14 suitable for providing an accessible surface to receive the head of a mallet, hammer, or other driving device to install the post reinforcement 10 by striking the strike surface 28 to drive the reinforcement 10 downwardly. The strike surface 28 may be integral with its respective panel 12, 14, or it may be a separate component attached thereto. Each panel 12, 14 may have a strike surface 28 that extends along the majority of the top 30 of its respective body 13. Alternately, one or more panels 12, 14 may lack a strike surface 28, and/or the strike surfaces 28 may extend along only a portion of the length of the top 30 of the body 13 of the panel 12, 14. Each or all of the strike surfaces 28 may have a surface area of at least about one square inch in one case, or at least about four square inches in another case, to provide a sufficient surface area for striking.

The post reinforcement 10 may include any of a variety of additional features to facilitate secure attachment to the target post 15. In one embodiment, one or more of the panels 12, 14 includes one or more openings 32 in the body 13 thereof. Each opening 32 may be sized and/or configured to receive a fastener 34 therein/therethrough, such as a wood screw, lag screw, etc. to directly secure the post reinforcement 10 to the target post 15. In one embodiment, panels 12, 14 positioned opposite to each other across the receptacle 16 (for example, the opposed side panels 14 in the depicted embodiment) may include aligned openings 36 to receive a bolt 38 or other fastener therethrough. To facilitate installation of the bolt 38, a bore may need to be drilled through the target post 15 at the appropriate location of the post 15 to line up with the openings 36. In one embodiment, the opening 36 on one side panel 14 may be slightly larger than the opening 36 on the opposite side panel 14 (for example, the opening 36 on one panel 14 can have a ⅜ inch diameter and the opening 36 on the other panel 14 can have a ½ inch diameter) to provide some flexibility in case the bore through the target post 15 is not perfectly aligned with the openings 36. A nut 40 (FIG. 1) may be used to secure the bolt 38 in place.

The bodies 13 of one or more of the panels 12, 14 of the post reinforcement 10 may further include one or more teeth 42 extending inward into/toward the receptacle 16 to penetrate into and grip the target post 15 above ground level. In the depicted embodiment, only the panels 14 include teeth 42, and the teeth 42 are at different vertical positions relative to each other on their respective panels 14 (see FIG. 3). The teeth 42 may be integral with the panels 14 to which they are attached, and they may be positioned/extend generally perpendicular to the body 13 of their respective panel 14.

In one embodiment, the post reinforcement 10 includes both the openings 32/36 and the teeth 42 on the same ones of panels 12, 14. Thus, the tightening of the bolt 38 and/or fastener 34 can serve to drive the teeth 42 into the target post 15. The teeth 42 may alternately be driven into the target post 15 by other means, including, for example via direct force applied to the panel 12/14 with a hammer, mallet, or the like. In the depicted embodiment, the teeth 42 are generally triangular in shape, but the teeth 42 may alternately be formed in any of a variety of shapes, for example jagged/serrated, W-shaped, U-shaped, square-shaped, trapezoidal, or any of a variety of other polygonal or curved forms.

The post reinforcement 10 may be constructed of any of a variety of materials, and the components thereof may be sized and proportioned according to the particular application, without departing from the scope of this disclosure. In one embodiment, the post reinforcement 10 is formed from a single unitary or integral, seamless sheet of material, for example in one case galvanized steel with a thickness of about ⅜ inch or greater. Accordingly, all of the components that form the basic body of the post reinforcement 10, including the panels 12, 14, the stake portions 18, the barbs 24, 26, the strike surfaces 28, the teeth 42, and the like may be shaped by cutting and bending the single sheet of material as appropriate. Alternately, the various components may be formed of a variety of materials including metals, polymers, composites, ceramics, plastics, acrylics, wood, and the like, or combinations thereof, and/or the various components may be separately formed and attached together by any of a variety of methods known in the art, such as welding, riveting, gluing, nailing, and the like, or combinations thereof.

One exemplary embodiment of the post reinforcement 10 suitable for reinforcing a 4"×4" wooden post may have dimensions as follows, constructed, for example, from a single sheet of galvanized steel. The reinforcement 10 may have three panels 12, 14, each with a body about 6 inches tall and about 3.75 inches wide, set perpendicularly to each other to define the receptacle 16 such as that shown in FIG. 1. Strike surfaces 28 may extend about ¼ inch outward from each panel 12, 14, in a direction perpendicular to the body 13 of the associated panel 12, 14 and away from the receptacle 16. Each panel 12, 14 may include a generally triangular stake portion 18 extending about 6 inches from the bottom 20 thereof and tapering from a width of about 2 inches at the bottom 20 of the panel 12, 14 to the point 22. Each stake portion 18 may be centered along the width of its respective panel 12, 14. Each stake portion 18 may have its lower tip 22 positioned inward in the direction of the receptacle 16 by about ⅛" to ¼" relative to the body 13 of the associated panel 12, 14. Each stake portion 18 may include an inwardly-oriented barb 24 and an outwardly-oriented barb 26, where each barb 24, 26 is formed from a generally-triangular notch cut into the stake portion 18 and bent inwardly/outwardly (as appropriate) such that the tip of the barb 24, 26 is positioned about ¼ of an inch from the main body of the respective stake portion 18. The barbs 24, 26 may up to between about 1 and 1.5 inches long.

Each panel 12, 14 may include openings 32 about ¼ inch in diameter to receive screws therein, which in one embodiment may be about 2 inches long. The opposed panels 14 may also include aligned openings 36 that are sized at about ⅜ inch in diameter on one panel 14 and about ½ inch in diameter on the other panel 14 to receive the bolt 38 therethrough. The side panels 14 may further include teeth 42 that are formed from generally-triangular notches about ¼ inch in length, cut into the bodies 13 of the side panels 14 and bent inwardly such that the teeth 14 extend into the receptacle 16 at about a 90° angle. It should be appreciated that these dimensions are exemplary only, and that a suitable post reinforcement 10 for a 4"×4" post, or other size post, may alternately take many of a variety of other specific dimensions.

The post reinforcement 10 may be used as follows, with reference to the non-limiting embodiment set forth above. The user locates a post 15 in need of reinforcement, for example a wooden, wood-based, composite or other type of post at risk of collapse due to rotting wood at or near ground level. The post reinforcement 10 is positioned about the outer perimeter of the target post 15 at ground level, with the points 22 of the stake portions 18 on the ground and the target post 15 received in the receptacle 16. To position the reinforcement 10 about the target post 15, it may be necessary to move the stake portions 18 outward against their bias to allow the post reinforcement 10 to fit about the post 15. A three-sided embodiment of the post reinforcement 10 may enable ease of installation by attaching the reinforcement 10 from the side of the post 15 in an interference/press fit, but a one, two, or four-sided embodiment may alternately be used. In one embodiment, two separate two-sided reinforcements 10 could be used to surround the entire target post 15 without the installment complications inherent to a four-sided design. In this case, however, the barbs 24, 26 and teeth 42 may need to be adjusted as desired.

Using a hammer, a mallet, or other appropriate tool, or in some cases stepping with a boot or the like, the user strikes the strike surfaces 28 to drive the reinforcement 10 into the support structure 17. It may be necessary to use the strike surfaces 28 on more than one of the panels 12, 14 to facilitate installation. The user continues to drive the reinforcement 10 into the support structure 17 until the stake portions 18 are entirely, or substantially entirely, embedded in the support structure 17, as shown in FIG. 5. The bottoms 20 of the panels 12, 14 may or may be driven into the support structure 17 to some extent. Bottoms 20 also act as a stop surface so the user knows when to stop driving the post reinforcement 10 into the support structure 17. Due at least in part to the bias of the stake portions 18, the points 22 thereof may penetrate into the target post 15 at a location beneath the top/ground level of the support structure 17. The barbs 24, 26 will thus serve as anchors to resist subsequent removal of the reinforcement 10 by pulling from above.

With the post reinforcement 10 in position in the support structure 17, wood screws 34 may be inserted through the openings 32 of the panels 12, 14 and driven into the target post 15 to secure the reinforcement 10 to the target post 15 above ground level. Further, a hole may be bored through the target post 15 between the openings 36 of the side panels 14, and a bolt 38 may be passed therethrough and secured with the nut 40 to provide further above-ground securement of the reinforcement 10. Securing the bolt 38 and/or the wood screws 34 also causes or assists the teeth 42 to penetrate the target post 15, providing still further support to keep the reinforcement 10 in place.

In one embodiment, the post reinforcement 10 may further be incorporated into a system including a chemical or substance that inhibits or prevents the rotting of wood. For example, a wood epoxy mixture may be spread on the base of the target post 15 before installation of the post reinforcement 10. In one embodiment, the interior portions of the post reinforcement 10 may be coated with such a product to facilitate its application to difficult-to-access portions of the target post 15, for example, to locations at or below ground level.

Accordingly, the disclosed post reinforcement 10 may extend the usable life of a post 15 that has been weakened at or near ground level, for example as a result of rotting wood, by strengthening the post 15 at the weakened location. Alternately, the post reinforcement 10 can be used at the time of installation of the post 15 and/or prior to showing signs of rot or weakness, as a protective measure.

Although the invention is shown and described with respect to certain embodiments, it should be clear that modifications will occur to those skilled in the art upon reading and understanding the specification, and the present invention includes all such modifications.

What is claimed is:

1. A post reinforcement comprising:

a first panel;

a second panel attached to the first panel at an angle thereto;

a third panel attached to the first panel at an angle thereto, wherein the first, second and third panels define a receptacle therebetween, each of the first, second and third panels includes a body portion, and at least one of the first, second or third panels includes a stake portion extending from a bottom of the associated body portion;

a barb positioned on the stake portion, said barb extending inwardly toward said receptacle with respect to a direction moving upwardly from a base of said barb; and a strike surface coupled to one of the second or third panels and oriented generally perpendicular to the body portion of the associated one of the second or third panel.

2. The post reinforcement of claim 1 further comprising a supplemental strike surface coupled to the other one of the second or third panels and oriented generally perpendicular to the body portion of the other one of the second or third panels.

3. The post reinforcement of claim 1 further comprising a first supplemental strike surface coupled to the other one of said second or third panels and oriented generally perpendicular to the body portion of the other one of the second or third panels, and a second supplemental strike surface coupled to said first panel and oriented generally perpendicular to the body portion of the first panel.

4. The post reinforcement of claim 1 wherein the strike surface is positioned at or adjacent to a top of the body portion of the associated one of the second or third panels opposite the stake portion, is generally flat and planar, and protrudes outwardly from the receptacle.

5. The post reinforcement of claim 1 wherein each of said first, second and third panels has a stake portion extending from the associated body portion.

6. The post reinforcement of claim 1 wherein the strike surface has a generally rectangular shape in top view.

7. The post reinforcement of claim 1 wherein the strike surface has a surface area of at least about four square inches in top view.

8. The post reinforcement of claim 1 wherein the stake portion extends from a bottom of the body portion of the associated panel at least partially inwardly in a direction toward an interior of the receptacle in a direction moving downwardly from the bottom of the associated panel.

9. The post reinforcement of claim 1 wherein the post reinforcement lacks a fourth panel fixedly and permanently positioned opposite to the first panel such that the post reinforcement is configurable in a generally "U" shape in top view to thereby enable a post to be laterally positioned in or removed from the receptacle.

10. The post reinforcement of claim 1 wherein the first panel, the second panel and the third panel are all made of a single, unitary seamless piece of material.

11. A post reinforcement comprising:

a first panel;

a second panel attached to the first panel at an angle thereto;

a third panel attached to the first panel at an angle thereto, wherein the first, second and third panels define a receptacle therebetween, each of the first, second and third panels includes a body portion, at least one of the first, second and third panels includes a stake portion extending from a bottom of the associated body portion, and wherein the post reinforcement lacks a fourth panel fixedly and permanently positioned opposite to the first panel such that the post reinforcement is configurable in a generally "U" shape in top view to thereby enable a post to be laterally positioned in or removed from said receptacle; and a barb coupled to the stake portion of the one of the panels, wherein said barb extends inwardly toward said receptacle with respect to a direction moving upwardly from a base of said barb.

12. The post reinforcement of claim 11 wherein the stake portion extends from the bottom of the associated body portion at least partially inwardly toward an interior of the receptacle in a direction moving downwardly from the bottom of the associated body portion.

13. The post reinforcement of claim 11 further comprising a strike surface coupled to one of the second or third panels and oriented generally perpendicular to the body portion of the associated one of the second or third panels.

14. The post reinforcement of claim 11 wherein each of said first, second and third panels has a stake portion extending from the associated body portion.

15. The post reinforcement of claim 11 wherein the first panel, the second panel and the third panel are all made of a single, unitary seamless piece of material.

16. A post reinforcement comprising:

a first panel;

a second panel attached to the first panel at an angle thereto;

a third panel attached to the first panel at an angle thereto, wherein the first, second and third panels define a receptacle therebetween, each of the first, second and third panels includes a body portion and at least one of the first, second and third panels includes a stake portion extending from a bottom of the associated body portion, the at least one of the first, second and third panels including the stake portion having a lateral width, wherein the stake portion extends from a bottom of the associated panel to a depth at least as great as the lateral width, and wherein the post reinforcement lacks a fourth panel fixedly and permanently positioned opposite to the first panel such that the post reinforcement is configurable in a generally "U" shape in top view to thereby enable a post to be laterally positioned in or removed from the receptacle; and a barb coupled to the stake portion, said barb extending inwardly toward said receptacle with respect to a direction moving upwardly from a base of said barb.

17. The post reinforcement of claim 16 wherein each panel is generally flat and planar.

18. The post reinforcement of claim 16 wherein the first panel, the second panel and the third panel are all made of a single, unitary seamless piece of material.

* * * * *